US007717425B2

(12) United States Patent
Kromydas

(10) Patent No.: US 7,717,425 B2
(45) **Date of Patent: *May 18, 2010**

(54) METHOD FOR MANUFACTURING AN ENHANCED REEL STRIP AND GAMING MACHINE

(75) Inventor: Stanley E. Kromydas, Henderson, NV (US)

(73) Assignee: Bally Gaming, Inc., Las Vegas, NV (US)

( * ) Notice: Subject to any disclaimer, the term of this patent is extended or adjusted under 35 U.S.C. 154(b) by 125 days.

This patent is subject to a terminal disclaimer.

(21) Appl. No.: 11/968,478

(22) Filed: Jan. 2, 2008

(65) Prior Publication Data

US 2008/0146317 A1 Jun. 19, 2008

Related U.S. Application Data

(63) Continuation of application No. 10/444,156, filed on May 23, 2003, now Pat. No. 7,316,395.

(51) Int. Cl.
*A63B 71/00* (2006.01)

(52) U.S. Cl. ..... 273/143 R

(58) Field of Classification Search ..... None
See application file for complete search history.

(56) References Cited

U.S. PATENT DOCUMENTS

| | | | | |
|---|---|---|---|---|
| 3,445,909 | A * | 5/1969 | Beebe, Jr. | 29/898.12 |
| 4,765,078 | A * | 8/1988 | Yamamoto | 40/309 |
| 5,395,111 | A * | 3/1995 | Inoue | 273/143 R |
| 5,863,249 | A * | 1/1999 | Inoue | 463/20 |
| 6,053,813 | A * | 4/2000 | Mathis | 463/26 |
| 7,316,395 | B1 * | 1/2008 | Kromydas | 273/143 R |
| 2001/0042329 | A1 * | 11/2001 | Murasko et al. | 40/544 |

* cited by examiner

*Primary Examiner*—Gene Kim
*Assistant Examiner*—Dolores Collins
(74) *Attorney, Agent, or Firm*—Marvin A. Hein

(57) ABSTRACT

An enhanced reel strip includes a base reel strip and an overlay strip, wherein the base reel strip has symbols applied thereto and the overlay strip has designated portions thereof removed to create cut-outs. The base reel strip and overlay strip are affixed in such a manner that the symbols of the base reel strip are visible through the cut-outs of the overlay strip. The joined strips produce an enhanced reel strip. Furthermore, these enhanced reel strip production methods dramatically improve the quality and appearance of reel strips while utilizing a relatively simple manufacturing process that maintains cost effectiveness.

18 Claims, 7 Drawing Sheets

FIGURE 4A
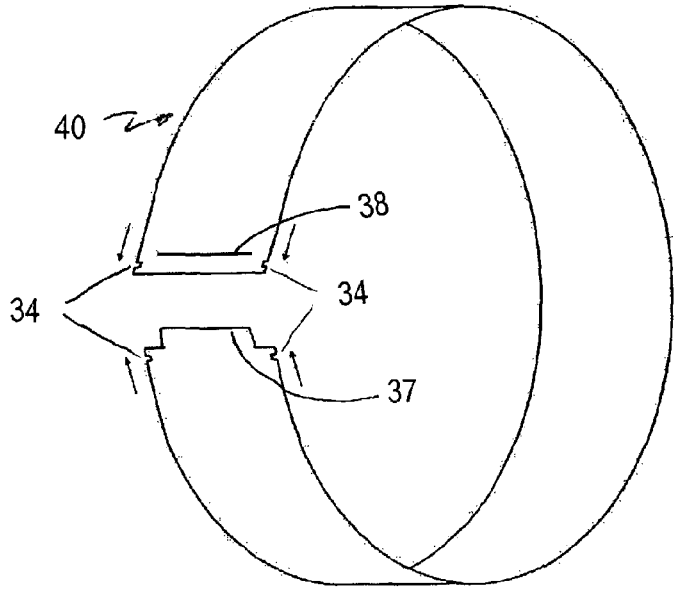
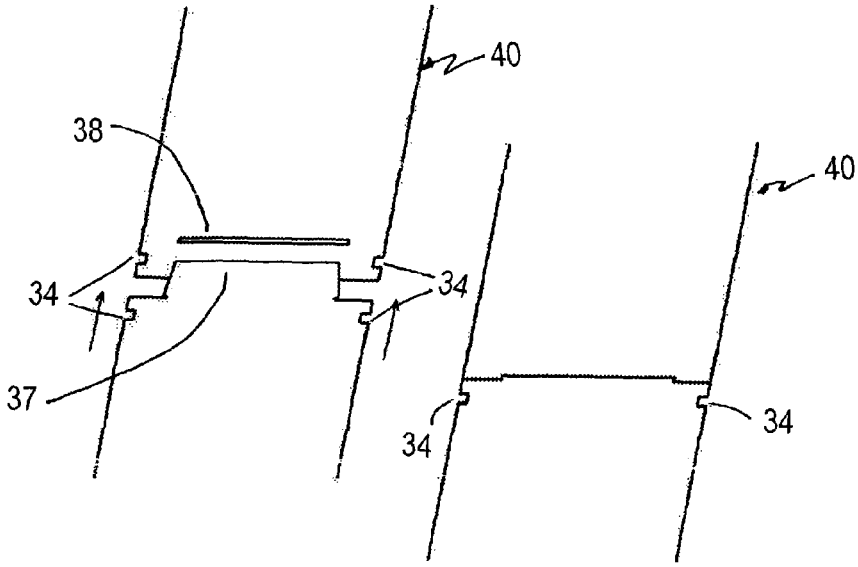
FIGURE 4B

METHOD FOR MANUFACTURING AN ENHANCED REEL STRIP AND GAMING MACHINE

RELATED APPLICATIONS

This application is a continuation of U.S. application Ser. No. 10/444,156 filed on May 23, 2003, hereby incorporated by reference in its entirety for all purposes.

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

BACKGROUND OF THE INVENTION

1. Field of the Invention

This invention relates generally to gaming systems, and more particularly, to a method for producing an enhanced reel strip and gaming machine with an enhanced reel strip.

2. Description of the Related Art

A variety of gaming machines are known in the art. This diversity provides players with many different options for gaming, interactivity and entertainment. In the past, gaming machines were mechanical or electro-mechanical in nature. However, more recently, there has been an emphasis in the gaming industry on computer or video gaming machines. One reason for the popularity of computer or video gaming machines is that each machine may be designed to provide a number of different games or gaming options to players. Additionally, computer or video gaming machines may have enhanced displays, such as sounds, flashing lights, scrolling text, and the like, which entice players to play and add to the overall excitement and entertainment of the games.

A persistent issue with computer or video gaming machines is that they are typically more complicated than mechanical gaming machines. This complexity requires specialized maintenance and electronics personnel to service the computer and video gaming machines. Moreover, a significant portion of the public has a fear or distrust of computers and computer generated games, such as video gaming machines, and prefer the electro-mechanical or mechanical gaming machines.

In this regard, much effort has been directed towards making the mechanical or electro-mechanical gaming machines more enticing and exciting to players. Many attempts have been made to increase the excitement and interactivity of mechanical gaming devices by adding secondary game features, such as additional buttons, bells, lights, whistles, top boxes, visual graphics, and the like. However, for some of the most popular mechanical gaming machines, i.e. reel spinners and slot machines, many manufacturers have directed their design efforts to the appearance of the reels themselves. By varying the overall appearance of the reels or the reel strips which are applied to the reels, it is possible to achieve gaming machine reel designs that look more elegant, are more entertaining and which add to the excitement and appeal of the game.

Those skilled in the art have designed reels capable of displaying multiple symbols or being implemented in different mediums. For instance, the symbols may be screen printed or stamped upon the reels themselves, inherently providing contrast between the symbol and the reel. However, this method limits the symbols on the reels to only one pattern and the reels must be swapped out from the machine to achieve different looks. Alternatively, symbols are screen printed, stamped or otherwise applied to the reel strips and the reel strips are then applied to the reels. In this regard, the reel strips may be swapped out to easily and quickly vary the reel symbols and appearances. Designers have also implemented different mediums for the reels, including fluorescent, prismatic, translucent, and transparent materials. These same materials are also used in the design of the reel strips so as to provide different effects as the reels are spun in the gaming machines.

Another popular effect is to use lighting to emphasize the reels of the gaming machines. For example, the gaming machine may be designed with front lights that shine on the exterior of the reels to highlight or reflect the reel surfaces. The effects of front lighting are relatively limited and do not provide much latitude for adding excitement in the design. Alternatively, gaming machines may be equipped with back lighting that highlights the underside of the reels and gives the effect that the reels are lit from within. While back lighting is easy to implement, depending on the materials utilized in the reels and the reel symbols, it may not give a dramatic and exciting effect to the reels.

It is also popular to light the reels themselves with electroluminescent lighting. In this regard, conductive materials are incorporated into the reel or reel strips, and when a voltage is applied across the reels, light elements are illuminated. Although electroluminescent lighting may provide dramatic and exciting enhancement of the reels, there are frequently problems with crimping and failure of the conductive materials in the reels such that the luminescent features are easily lost and costly to repair. Moreover, the difficulty and costs associated with manufacturing electroluminescent reel strips are prohibitive. Finally, for any of the above lighting options for reels or reel strips, if the light source on the gaming machine is malfunctioning, most if not all of the lighting effects are lost.

One significant problem with enhanced reel strips, in general, is that they are difficult and costly to manufacture. For example, the quality of the images applied on to the reel strips by processes such as screen-printing, digital imaging or photographic imaging may be compromised. Often the images do not have sufficient depth of color or are blurred. Likewise, the images may lack vibrancy and look dull, particularly where harsh lights or backlighting are used. Also, there is concern for the quality of the strip where a designer seeks to add borders, outlines around the images, or an appliqué effect to the strip. Without precise placement of the borders, outlines, or appliqués, the overall quality and appearance of the reel strips is significantly diminished.

Gaming machine manufacturers are always seeking new ways to increase the attractiveness and excitement of mechanical gaming devices. However, while having a gaming machine that attracts and excites players is important, the simplicity of the operation and maintenance of the machine and the cost effectiveness of enhancements to the gaming machine are also important. Similarly, for reel strips, the difficulty and costs of manufacturing enhanced reel strips are essential considerations. The present invention clearly addresses these needs and other concerns.

SUMMARY OF THE INVENTION

In accordance with the present invention, a method for manufacturing an enhanced reel strip and a gaming machine with an enhanced reel strip is provided that includes the steps of combining a base strip and overlay strip to achieve a variety of desired effects on the resultant enhanced reel strip and to increase attractiveness and excitement of gaming machines which include mechanical presentations, such as may be generated with mechanical reels. More particularly, the present invention discloses a method for producing the enhanced reel strips such that quality and appearance are dramatically improved while a relatively simple manufacturing process maintains cost effectiveness.

In accordance with one or more aspects, the base material comprising the base strip may be a flexible, translucent or transparent material upon which symbols are applied. The symbols can be of almost any design and may be applied to the base material by any method that results in suitable color depth, image clarity and fastness. The overlay strip is also typically a flexible material, however because it is intended to be decorative, it is usually colored, patterned or textured. Sections of the overlay strip are removed to form cut-outs. The underside of the overlay strip is adhered to the front side of the base strip in such a manner that the symbols on the base strip are visible through the cut-outs of the overlay strip. In this regard, it is preferred that the cut-outs will be sized slightly larger than the symbols so as to produce an open border area around each symbol.

The overlay strip may be comprised of a multitude of different materials. By way of example only and not by way of limitation, different overlay materials may include metalized foil, holographic, prismatic, glitter, phosphorescent, fluorescent, mirrored or textured materials. Likewise, it is envisioned that the overlay material may be provided in a variety of colors, be plain, and/or have a pattern. Preferably, the overlay material is visually stimulating. Further, the overlay material preferably corresponds to the machine environment in which it is used, particularly the lighting environment of back light or non-back light applications. Preferably, the overlay material is easily incised and manipulated to facilitate the removal of the cut-outs from the overlay strip. Additionally, the overlay material preferably is sufficiently flexible and capable of attachment to the base reel strip to ensure that the resultant enhanced reel strip may be wrapped and secured about the slot reel.

In accordance with the present invention, the cut-outs are sized slightly larger than the symbols, which create an open border area around the symbols. Consequently, when the resultant enhanced reel strip is used in a backlight application, the symbols and the open border areas around them are backlit. That is, light passing through the open border areas of the cut-outs appears clear and very bright, while the light passing through the symbols appears colored, thus highlighting the symbols on the reels. Moreover, even if the enhanced reel strips are used in a non-backlight application, such as front lighting or ambient lighting, the difference in the light passing through the open border areas and the light passing through the symbols is still perceptible. Thus, in any foreseeable lighting application, the open border areas and the decorative overlay serve to emphasize the symbols and add to the overall attractiveness of the enhanced reel strip.

In accordance with one aspect of the present invention, the enhanced reel strips are produced via a series of manufacturing steps. First, a base reel strip is produced by applying symbols to a base material. The base material suitable for production of the base reel strip is preferably a flexible, translucent material that is capable of accepting the applied symbols. By way of example only, and not by way of limitation, suitable base materials are flexible, translucent or substantially transparent materials, such as plastics, mylars, polyesters, or similar composite materials. The application of the symbols to the base reel strip is preferably accomplished by a method, including but not limited to, screen-printing, appliqués, digital imaging or photographic imaging. However, any method of application, which produces a clear and firmly-fixed symbol to the base material, is acceptable.

Next, an overlay strip for the base reel strip is produced. This overlay strip is decorative and may be produced in a variety of shapes, colors, iridescence, and the like to provide different effects to the reel strip. In areas of the enhanced reel strip that are to be highlighted, the overlay material is removed by cutting the designated portions of the overlay material to produce a desired effect. By way of example only, and not by way of limitation, methods for removing designated portions of the overlay material includes die cutting, pin routing, laser cutting, or other such methods. Preferably, the back surface of the overlay material, which will not be visible when the enhanced reel strip is in use, is treated with a flexible adhesive or other similar fastening substance for affixing the overlay material to the base reel strip.

Once the overlay strip and base reel strip are prepared, they are joined or affixed together. A preferred method for applying or joining the overlay strip and the base reel strip, and thereby produce the enhanced reel strip, is a registration or pin system. Using the methodology, a base reel strip is placed into a registration system with the symbols of the base reel strip facing outward, i.e. the front surface of the base reel strip, facing outward. Additionally, this method includes preparing the underside adhesive surface of the overlay strip. The overlay strip is then aligned with and placed over the base reel strip in the registration system. Slight pressure methods, such as hand or light mechanical pressure, are used to initially contact the base reel strip and the overlay strip together. Preferably, the two strips are then firmly adhered together using a press or pinch roller system. Similar mechanisms may also be utilized.

In accordance with another aspect of the present invention, the process for producing enhanced reel strips is preferably also used to produce other portions of the gaming machine to increase visual presentation, design, theme and excitement. For example, the process may be used for manufacturing inserts for top awards, denomination information pertaining to play of the game, associated toppers, door inserts, and the like.

Other features and advantages will become apparent from the following detailed description, taken in conjunction with the accompanying drawings, which illustrate by way of example, the features of the various embodiments.

BRIEF DESCRIPTION OF THE DRAWINGS

FIG. 4A is a perspective view of a reel strip illustrating notches and a tongue and groove for attachment of the reel strip about the perimeter of the slot reel.

FIG. 4B is a schematic of the joining of first and second ends of a reel strip using a tongue and groove for attachment of the reel strip about the perimeter of the slot reel.

DETAILED DESCRIPTION OF THE INVENTION

In accordance with the present invention, an improved system and method for producing an enhanced reel strip for use in a mechanical slot reel gaming device is described herein. The enhanced reel strip and method for producing it provides a visually enticing, attractive and exciting gaming system. The enhanced reel strip production method further provides reel strips of improved quality, while maintaining the cost efficiency of manufacturing the enhanced reel strips. The preferred embodiments of the improved reel strip and method are illustrated and described herein by way of example only, and not by way of limitation.

Figure 1:
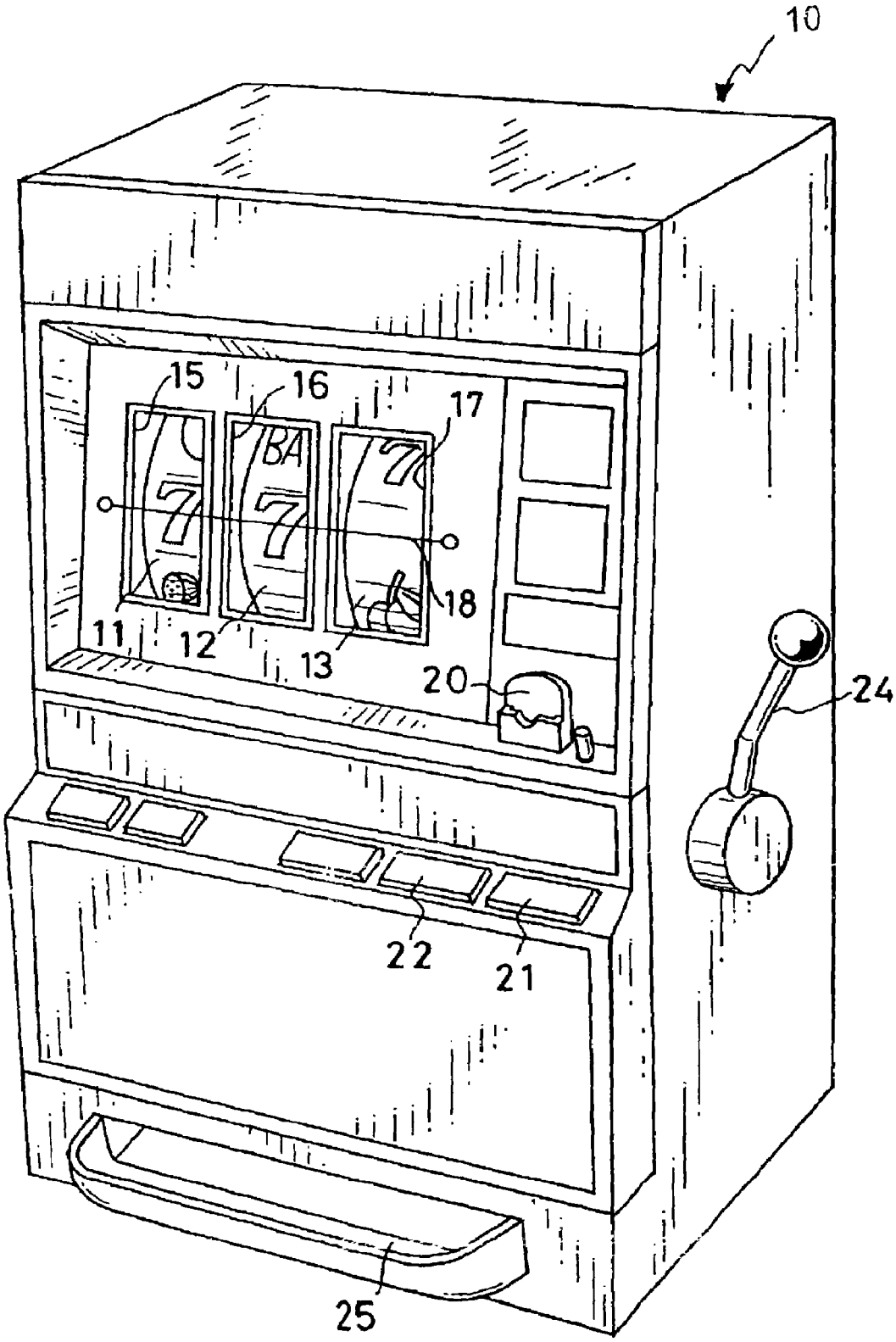
FIG. 1 is a perspective view of a slot reel mechanical gaming device.
Figure 3:
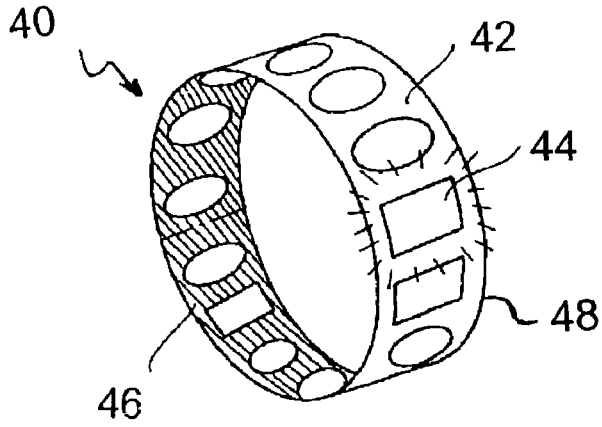
FIG. 3 is a perspective view of a slot reel strip having solid and removed or transparent portions.
Figure 4:
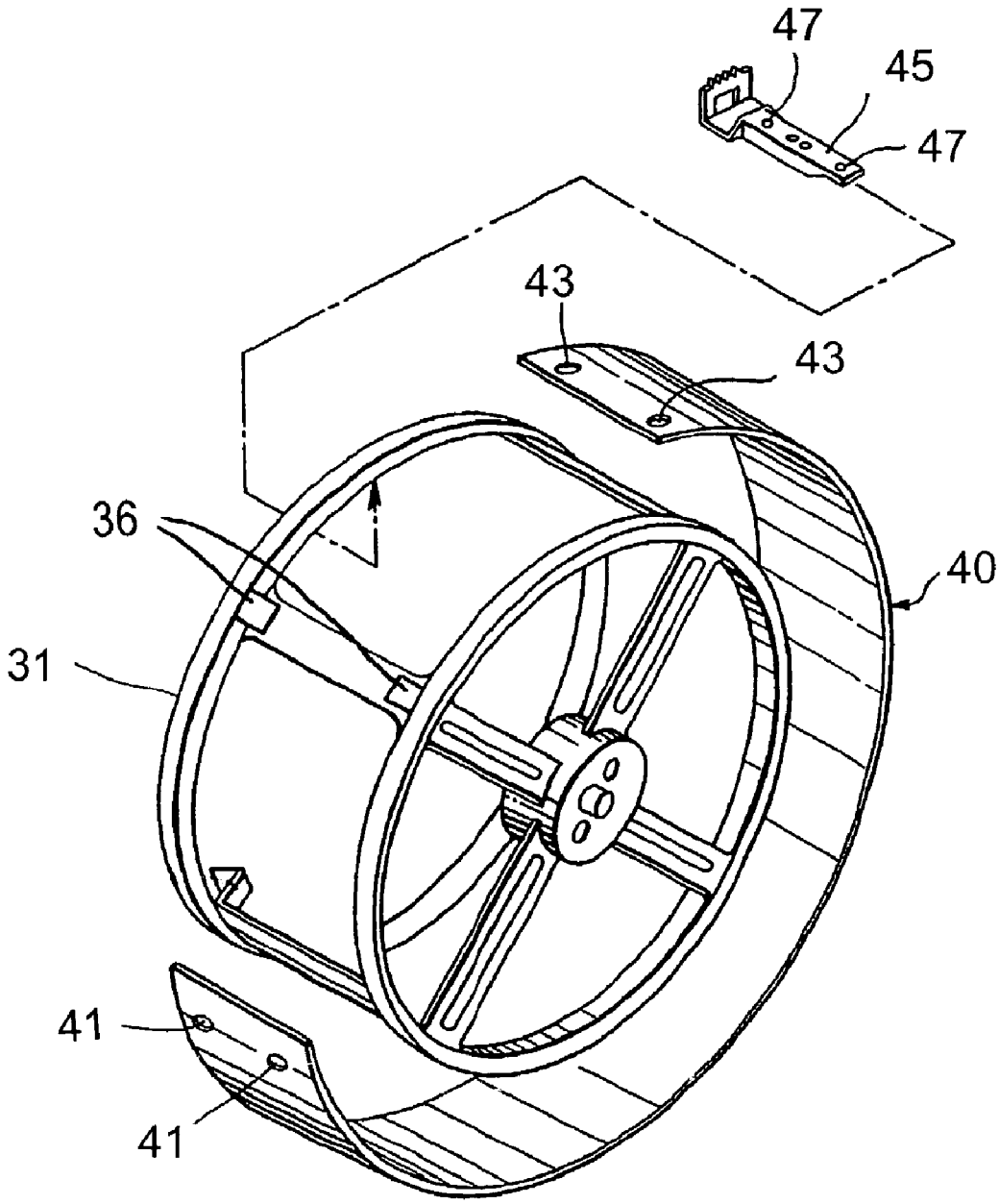
FIG. 4 is a perspective view of a slot reel wherein a reel strip is attached to the outside perimeter of the slot reel.
Figure 5:
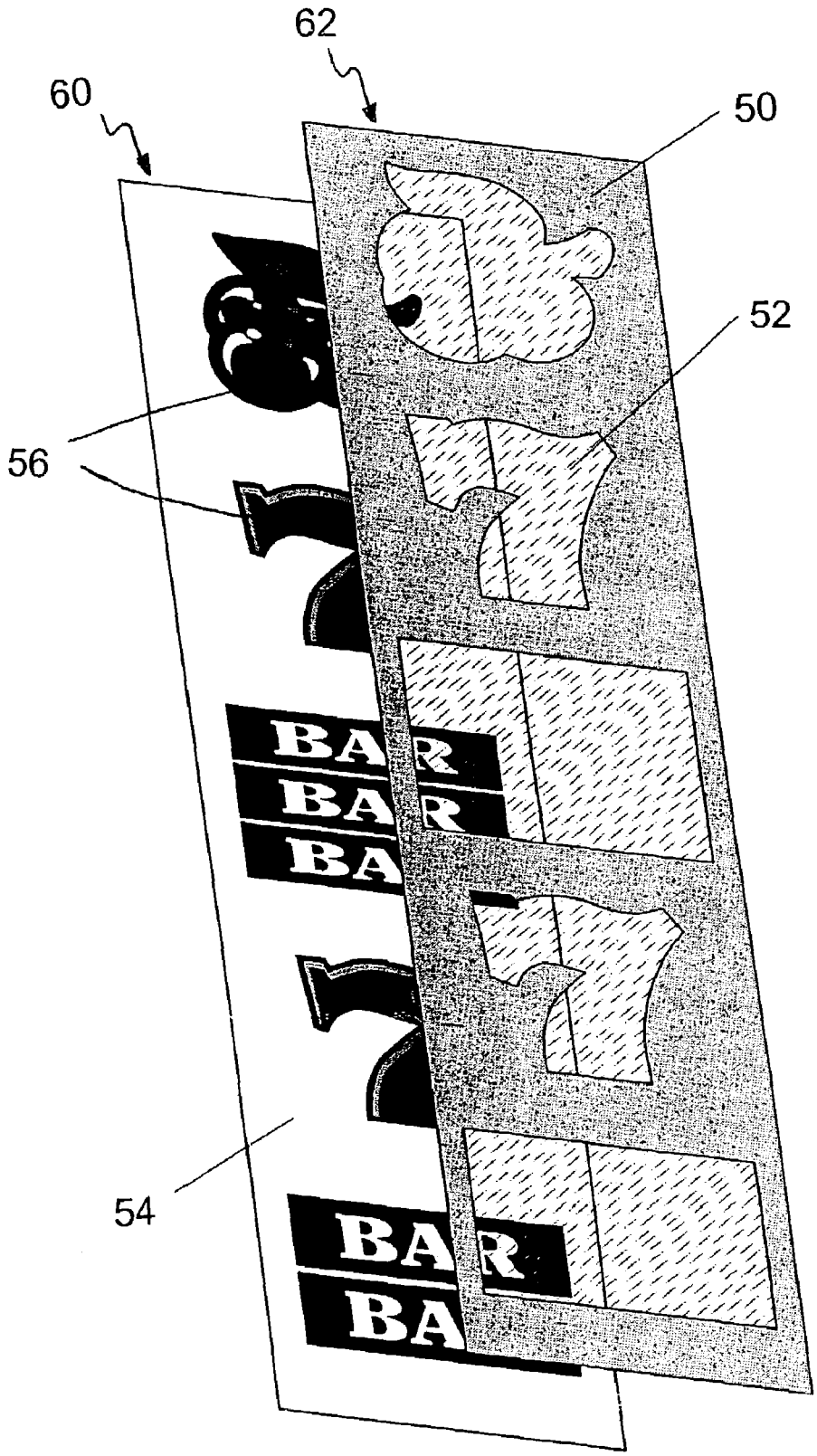
FIG. 5 is a perspective view of a base reel strip having symbols applied thereto and an overlay strip with designated areas of the overlay material having been removed, pursuant to an embodiment of the present invention.
Figure 6:
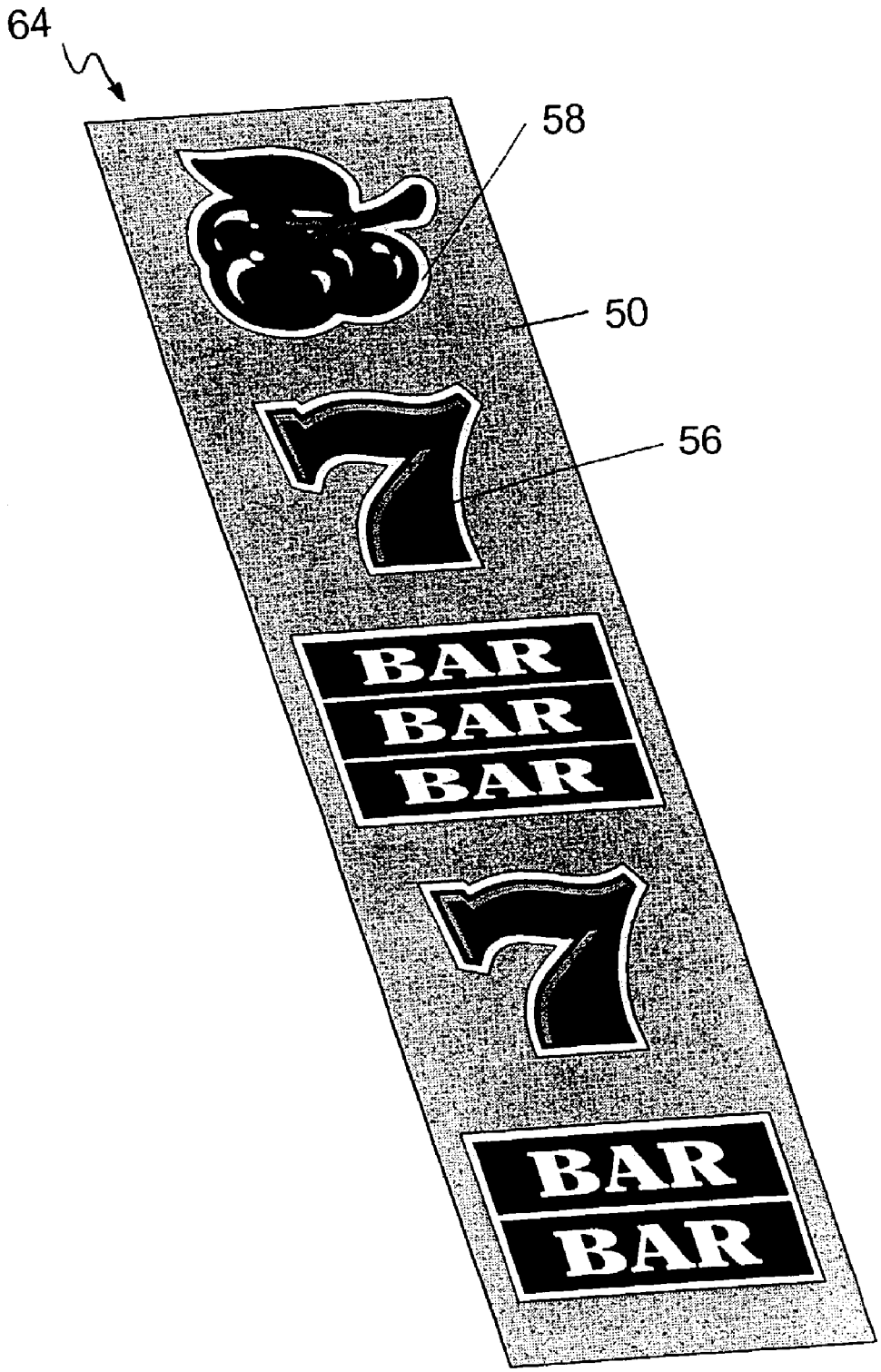
FIG. 6 is a perspective view of an enhanced reel strip wherein a base reel strip, with applied symbols, and an overlay strip have been joined, pursuant to an embodiment of the invention.
Figure 7:
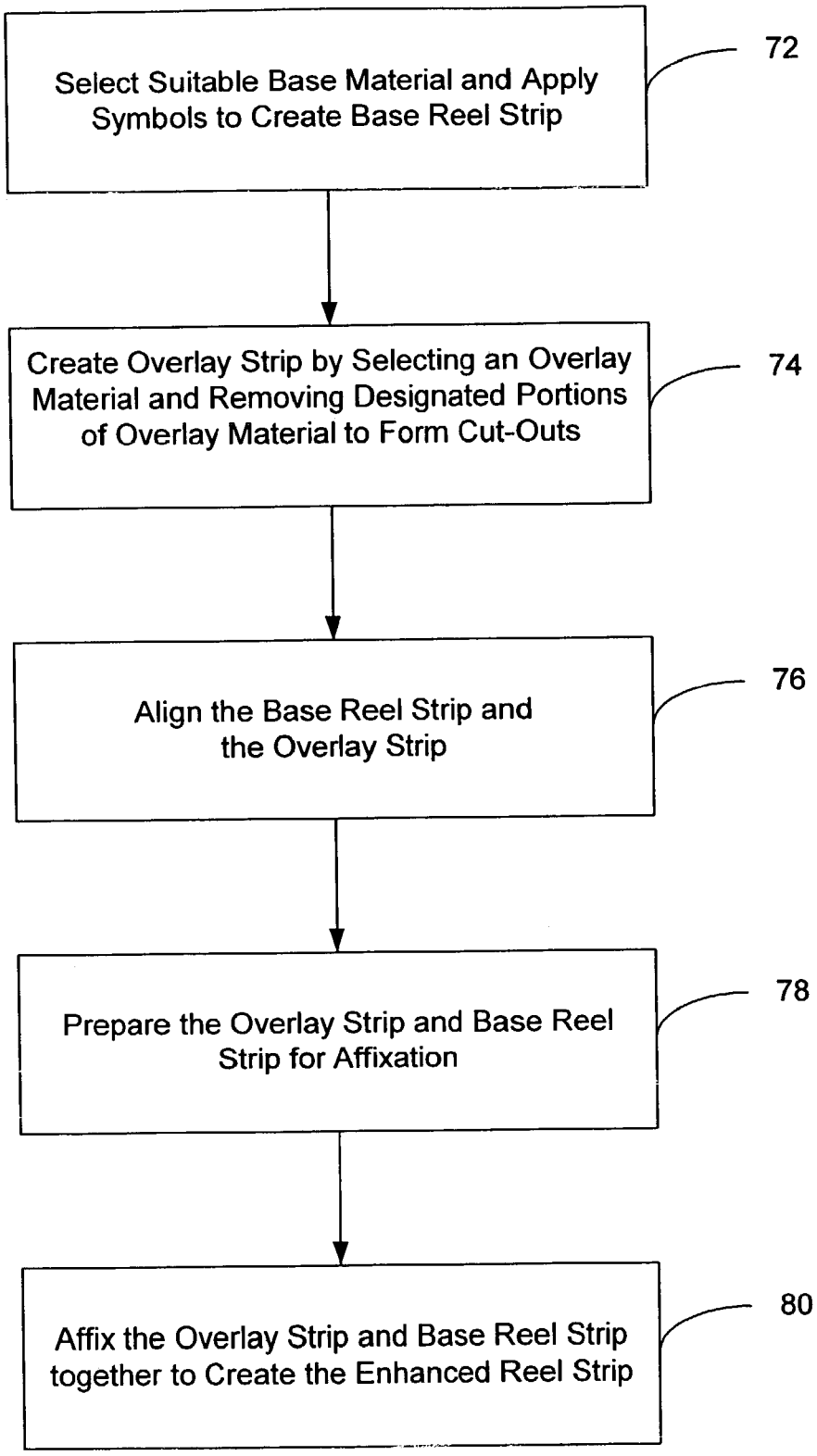
FIG. 7 is a flow diagram of a process for manufacturing an enhanced reel strip, pursuant to an embodiment of the invention.

Referring now to the drawings FIGS. 1-7, wherein like reference numerals denote like or corresponding parts throughout the drawing figures, and particularly to FIGS. 5-7, an enhanced reel strip system and method is provided for use in a mechanical slot reel gaming device 10. As illustrated in the mechanical slot reel machine embodiment of FIG. 1, the slot reels 11, 12, 13 are visible to a player through the corresponding viewing windows 15, 16, 17. Although FIG. 1 shows a gaming machine having three slot reels 11, 12, 13 and three viewing windows 15, 16, 17, it is known that gaming machines may be configured with fewer or more than three reels and/or viewing windows. Moreover, the reels may be placed in other areas of the gaming machine, such as, by way of example and not by way of limitation, a top box, to create additional features or awards for the play of game. A player initiates play of the gaming machine by inserting coins into the coin-in 20, betting using the "bet" button 22, and activating the lever 24 or "spin" button 21 to cause the reels 11, 12, 13 to spin. If a winning combination is displayed on the reels along the payout line 18, a payout is dispensed to the player in the tray 25 or through other means.

Figure 2:
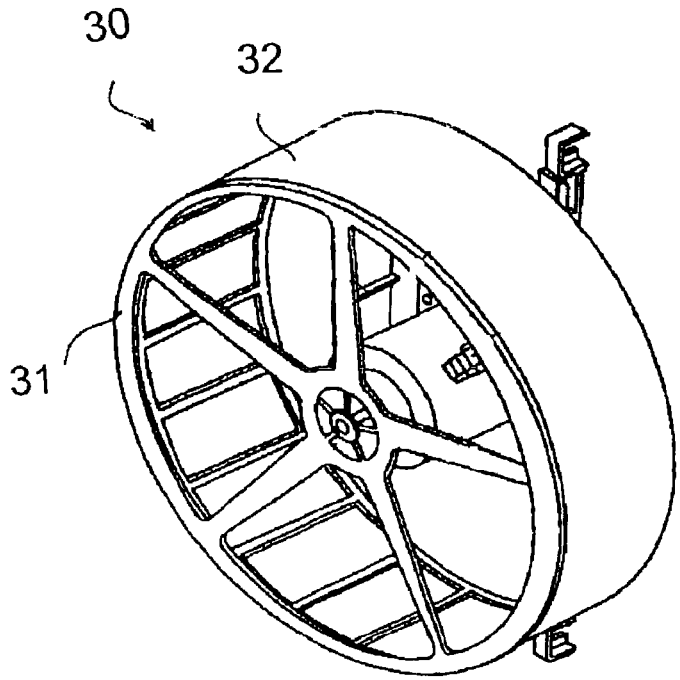
FIG. 2 is a perspective view of a slot reel illustrating a surface upon which a reel strip may be attached.

As shown in the FIG. 2, a slot reel 30 is configured with a support structure 31 having a circumferential surface 32. It is around this circumferential surface 32 that various reel strips may be applied or mounted (see, e.g., FIG. 4). FIG. 3 is a reel strip 40 showing a top surface 48 that is displayed to a player of the game as the reels 30 are spun. The top surface 48 of the reel strip 40 includes solid portions 42 and removed or transparent portions 44. The reel strip 40 may also include a bottom surface 46 that is placed against the circumferential surface 32 of the slot reel 30. In this regard, the removed or transparent portions 42 and solid portions 44 of the reel strip 40 provide different effects and appearances for the reels.

As demonstrated in FIG. 4, a reel strip 40 may be applied or mounted to a slot reel 30 by winding the reel strip around the slot reel and securing the ends of the reel strip. Two screw holes 41 are provided at a first end of the reel strip 40 and two screw slots 43 are provided at a second end of the reel strip. The screw holes 41 correspond to screw holes 47 formed in a reel strip fixing means 45. The screw holes 41, screw slots 43, and screw holes 47 on the reel strip fixing means 45 are fashioned such that they overlap when the reel strip 40 is wound around the circumference of the slot reel 30, and the reel strip may be secured with screws through the reel strip fixing means 45. In this manner, the reel strip 40 is secured about the slot reel 30.

Alternatively, as shown in FIGS. 4, 4A, and 4B, first and second ends of the reel strip 40 are configured with notches 34. These notches 34, correspond to notches 36 on the slot reel 30 and aid to secure the reel strip 40 into position about the slot reel. The first end of the reel strip 40 is further configured with a tongue 37 and the second end of the reel strip is configured with a groove 38. The tongue 37 and groove 38 are matched such that when the reel strip 40 is placed about the slot reel 30, the tongue 37 joins with the groove (see FIG. 4B) to aid in securing the reel strip in place about the slot reel. Preferably, the enhanced reel strip 64 of the present invention is secured about a slot reel 30, as described above or in a similar manner.

An embodiment of the present invention is disclosed in FIGS. 5 and 6. In a preferred embodiment, the enhanced reel strip and production method facilitates a larger diversity of reel appearances through the manufacture and use of enhanced reel strips, which are easily and economically produced. In FIG. 5, two strips, the base strip 60 and the overlay strip 62, are shown. As exhibited in FIG. 6, these two strips comprise the enhanced reel strip 64.

The base reel strip 60 comprises a suitable base material 54 and symbols 56. In a preferred embodiment, the base material 54 is a flexible, translucent material. Additional suitable base materials include, but are not limited to, flexible, translucent or substantially transparent plastics, mylars, polyesters or similar composite materials. As the symbols 56 are applied to the base material 54 to produce the base reel strip 60, the base material should be capable of accepting the applied symbols 56 and producing clear, firmly-fixed symbols on the base material. In this regard, various methods may be used to apply the symbols 56 to the base material 54, including by way of example only, and not by way of limitation, screen-printing, appliqués, digital imaging, or photographic imaging.

In order to achieve a variety of effects with enhanced reel strips 64, the overlay strip 62 may be comprised of a multitude of types of materials, each offering a different appearance to the reels. In one embodiment, for example, that the overlay material 50 is selected from metalized foil, holographic, prismatic, glitter, phosphorescent, fluorescent, mirrored, and textured materials. Preferably, the overlay material 50 is provided in a variety of colors and may be plain or have a pattern. The overlay material 50 is selected to be visually stimulating and work well with the machine environment (i.e., lighting) in which it is used. Preferably, the overlay material 50 is easily manipulated to facilitate the removal of cut-outs 52 from the overlay strip 62, and is sufficiently flexible to facilitate wrapping about the slot reel. Further, the overlay material must also be capable of firm attachment to the base reel strip 60.

In a preferred embodiment, the cut-outs 52 are configured to correspond in shape to the symbols 56, but are slightly larger than the symbols. In this regard, the cut-outs 52 create an open border area 58 around the symbols 56 when the overlay strip 62 is centered over and applied to the base reel strip 60. By altering the size of the cut-outs 52 relative to the size of the symbols 56, the effect of the open border areas 58 may be manipulated. In another embodiment, the open border areas 58 are not equally-spaced and/or centered relative to the symbols 56. Moreover, in still other embodiments, the cut-outs 52 have a shape other than that of the corresponding symbols 56. That is, shapes such as, by way of example only, and not by way of limitation, squares, circles and triangles might comprise cut-outs 52 corresponding to symbols 56 shaped as, by way of example only, and not by way of limitation, sevens, cherries and bars.

When the enhanced reel strip 64 is used in conjunction with a backlighting system, the symbols 56 and the open border areas 58 around them are backlit. In this regard, light passing through the open border areas 58 of the cut-outs 52 appears clear, while the light passing through the symbols 56 appears colored. This backlighting produces additional effect and draws a player's attention to the symbols 56 on the reels 30.

In a further embodiment where front lighting is used, the light passes through the open border areas 58, while the light passing through the symbols 56 highlights the colors of the symbols 56. Additionally, in embodiments where no internal machine lighting is provided, ambient light from the surroundings provides an effect that is similar to, but less intense, than front lighting. In either instance, the open border areas 58 serve to emphasize the symbols 56 on the enhanced reel strip 64. Contemporaneously, the selection of the overlay material 50 itself also provides emphasis to the symbols 56 and to the enhanced reel strip 64.

In accordance with one aspect of the preferred embodiment, the enhanced reel strips 64 are produced in a series of manufacturing steps as illustrated in FIG. 7. First, a base reel strip 60 is produced 72 by selecting a suitable base material 54 and applying symbols 56 to the base material. In order to be suitable for the production of the enhanced reel strips 64, the base material 54 of the base reel strip 60 is preferably a flexible, translucent material. By way of example only, and not by way of limitation, suitable base materials are flexible, translucent or substantially transparent materials such as plastics, mylars, polyesters or similar composite materials. Since the symbols 56 are applied to the base material 54, the base material should be capable of accepting the applied symbols 56 and producing clear, firmly-fixed symbols 56 on the base material. In this regard, the application of the symbols 56 to the base material 54 may be accomplished by any number of methods, including but not limited to, screen-printing, appliqués, digital imaging or photographic imaging. The application of the symbols 56 to the base material 54 creates the base reel strip 60.

Once the base reel strip 60 has been created 72, the next step in the process of manufacturing the enhanced reel strip 64 is to select an overlay material 50 that is suitable to create the desired effect on the enhanced reel strip 64 and to facilitate removal of designated portions of the overlay material 50, thereby forming cut-outs 52 (74). Preferably, the overlay material 50 is flexible, capable of being affixed to the base reel strip 60, suitable for easy incision and removal of designated cut-outs 52, and visibly appealing. The overlay strip 62 is decorative and may be produced in a variety of shapes, colors, iridescence, and the like to provide different desired effects to the enhanced reel strip 64.

In order to highlight areas of the enhanced reel strip 64, certain portions, i.e. the cut-outs 52, of the overlay material 50 are removed. The removal of the cut-outs 52 of the overlay material 50 creates the overlay strip 62 (74). When the overlay strip 62 and the base reel strip 60 are aligned 76 and joined, the symbols 56 on the base reel strip 60 are visible through the cut-outs 52 in the overlay material 50. Although almost any means for removing the cut-outs 52 from the overlay material 50 may be used, preferred methods for removing designated portions of the overlay material 50 include, but are not limited to, die cutting, pin routing, and laser cutting.

Once the base reel strip 60 and the overlay strip 62 are created, the strips are prepared to be affixed 78 and thereby form the enhanced reel strip 64. In order to facilitate the application of the overlay strip 62 to the base reel strip 60, the back surface of the overlay material 50, which is not be visible when the enhanced reel strip 64 is in use, is treated with a flexible adhesive or other similar fastening substance 78. Alternatively, an overlay material 50 having a pre-treated back surface is used, wherein the back surface includes a flexible adhesive and a protective backing 78. In this manner, the protective backing on the overlay material 50 is simply removed to prepare the overlay strip 62 for adherence to the base reel strip 60 (78). Thus, the adhesive surface of the overlay strip 62 is readied by removing a backing material, wetting to activate the adhesive or otherwise preparing the overlay strip 62 for adherence to the base reel strip 60. In one embodiment, a flexible adhesive is applied to the top surface of the base reel strip 60, in addition to, or instead of the back surface of the overlay strip 62 to facilitate adherence of the two strips 78. In this embodiment, the overlay strip 62 is affixed to the base reel strip 60 to jointly comprise the enhanced reel strip 64.

As illustrated in FIG. 7, the final step 80 of the process for manufacturing an enhanced reel strip is to adhere the overlay strip 62 to the base reel strip 60. The attachment of the overlay strip 62 and base reel strip 60 may be accomplished by any method that results in proper alignment. However, a preferred method for applying or joining the overlay strip 62 and the base reel strip 60 is a registration or pin system. In this regard, the base reel strip 60 is placed into the registration system with the symbols 56 facing outward. The overlay strip 62 is then aligned with, placed over, and adhered to, the base reel strip 60. Together, the overlay strip 62 and the base reel strip 60 form the enhanced reel strip 64.

The base reel strip 60 and the overlay strip 62 components are initially contacted and pressed together using modest pressure. For example, but not by way of limitation, hand pressure or gentle mechanical pressure methods may be used to adhere the two components. In one preferred embodiment, as shown in FIG. 6, the base reel strip 60 and the overlay strip 62 are aligned and centered such that an equal amount of open border area 58 is apparent on all sides of the symbols 56. Alternatively, in an embodiment that utilizes cut-outs 52 of a different shape than the corresponding symbols 56, the symbols should be centered within the cut-outs. Once proper alignment of the overlay strip 62 and the base reel strip 60 is ensured, the two strips are firmly adhered together using a press, roller system, pinch roller system, or similar mechanism.

In accordance with another aspect of a preferred embodiment, the process for producing enhanced reel strips is used to produce other portions of the gaming machine, thereby increasing visual presentation, design, theme and excitement. For instance, the process may be used for manufacturing inserts for top awards, denomination information pertaining to play of the game, associated toppers, door inserts, or the like.

Furthermore, the various embodiments and methodologies described above are provided by way of illustration only, and should not be construed to limit the invention. Those skilled in the art will readily recognize various modifications and changes may be made to the present invention without departing from the true spirit and scope of the present invention. Accordingly, it is not intended that the present invention be limited, except as by the appended claims.

What is claimed:

1. A method for manufacturing an enhanced reel strip, the method comprising the steps of:

producing a base reel strip by selecting a flexible substantially translucent or transparent base material and applying symbols to the base material;

producing an overlay strip by selecting an opaque overlay material and removing designated portions of the overlay material to form cut-outs;

aligning the base reel strip and the overlay strip;

preparing the overlay strip and the base reel strip for affixation to one another;

and affixing the overlay strip and the base reel strip together.

2. The method of claim 1, wherein the base material is selected from the group consisting of plastics, mylars, and polyesters.

3. The method of claim 1, wherein the selected overlay material is a flexible material capable of affixation to the base reel strip, and wherein the overlay material has sufficient manipulability to facilitate the removal of the designated portions of the overlay material, thereby forming cut-outs.

4. The method of claim 1, wherein the overlay material is colored, patterned or textured.

5. The method of claim 1, wherein the overlay material includes metalized foil, holographic material, prismatic material, phosphorescent material, fluorescent material, mirrored material, glitter or combinations thereof.

6. The method of claim 1 further comprising: selecting sizes, shapes, and positions of the cut-outs in the overlay material.

7. The method of claim 6, wherein the cut-outs are sized, shaped, and positioned to create open border areas that are visible around the symbols when the overlay strip and the base reel strip are affixed together and subjected to an illuminating source.

8. The method of claim 1, wherein designated portions of the overlay material are removed by die cutting, pin routing, or laser cutting to form the cut-outs.

9. The method of claim 1, wherein the base reel strip and the overlay strip are aligned enabling the symbols on the base reel strip to be visible through the cut-outs of the overlay strip.

10. The method of claim 9, wherein the base reel strip and the overlay strip are aligned with a registration system comprising alignment pins, in which the base reel strip is placed into the registration system with the symbols facing outward and the overlay strip is then aligned with and placed over the base reel strip using the pins, enabling the symbols to be visible through the cut-outs.

11. The method of claim 1, wherein preparing the overlay strip and the base reel strip for affixation comprises treating a back surface of the overlay strip with a flexible, fastening substance.

12. The method of claim 11, wherein the overlay strip comprises a protective backing, and wherein the protective backing is removed to expose the flexible fastening substance for affixation to the base reel strip.

13. The method of claim 1, wherein preparing the overlay strip and the base reel strip for affixation comprises treating a top surface of the base reel strip with a flexible, fastening substance.

14. The method of claim 1, wherein preparing the overlay strip and the base reel strip for affixation comprises treating a top surface of the base reel strip with a flexible, fastening substance and treating the back surface of the overlay strip with a flexible, fastening substance.

15. The method of claim 1, wherein the base reel strip and the overlay strip are affixed by initially contacting the strips together, asserting modest pressure to adhere the strips until proper alignment is ensured, and firmly adhering the strips together.

16. The method of claim 15, wherein the modest pressure used to adhere the strips together until proper alignment is ensured comprises hand pressure or gentle mechanical pressure.

17. The method of claim 15, wherein the strips are firmly adhered together using a press or pinch roller system.

18. An enhanced reel strip produced by the method of claim 1.

* * * * *